US006461564B1

(12) United States Patent
Dilmore et al.

(10) Patent No.: US 6,461,564 B1
(45) **Date of Patent: *Oct. 8, 2002**

(54) METAL CONSOLIDATION PROCESS APPLICABLE TO FUNCTIONALLY GRADIENT MATERIAL (FGM) COMPOSITIONS OF TANTALUM AND OTHER MATERIALS

(76) Inventors: Morris F. Dilmore, 5928 Jack Stokes Rd., Baker, FL (US) 32531; Henry S. Meeks, III, 1319 Meadow Vista Way, Roseville, CA (US) 95661; Marc S. Fleming, 19523 Silverwood Way, Rancho Cordova, CA (US) 95670

( * ) Notice: Subject to any disclaimer, the term of this patent is extended or adjusted under 35 U.S.C. 154(b) by 51 days.

This patent is subject to a terminal disclaimer.

(21) Appl. No.: 09/592,974

(22) Filed: Jun. 12, 2000

Related U.S. Application Data

(63) Continuation-in-part of application No. 09/551,248, filed on Apr. 18, 2000, now Pat. No. 6,355,209.
(60) Provisional application No. 60/165,781, filed on Nov. 16, 1999.

(51) Int. Cl.[7] ..... B22F 3/12
(52) U.S. Cl. ..... 419/38; 419/49
(58) Field of Search ..... 419/38, 49

(56) References Cited

U.S. PATENT DOCUMENTS 4,140,711 A 2/1979 Convers
4,539,175 A 9/1985 Lichti et al.
4,640,711 A * 2/1987 Lichti et al. ..... 75/248
4,853,178 A * 8/1989 Oslin ..... 419/23
4,915,605 A * 4/1990 Chan et al. ..... 419/6
4,933,140 A 6/1990 Oslin
5,032,352 A * 7/1991 Meeks et al. ..... 419/8
6,309,594 B1 * 10/2001 Meeks, III et al. ..... 419/52

* cited by examiner

*Primary Examiner*—Daniel J. Jenkins
(74) *Attorney, Agent, or Firm*—William W. Haefliger

(57) ABSTRACT

The method of consolidating a body in any of initially powdered, sintered, fibrous, sponge, or other form capable of compaction, that includes providing flowable pressure transmission particles having carbonaceous and ceramic composition or compositions; heating particles to elevated temperature; locating the heated particles in a bed; positioning the body at the bed, to receive pressure transmission; effecting pressurization of the bed to cause pressure transmission via the particles to the body, thereby to compact and consolidate the body into desired shape, increasing its density, the body consisting essentially of one or more metals selected from the following group: tungsten, rhenium, uranium, tantalum, platinum, copper, gold, hafnium, molybdenum, titanium, zirconium, aluminum, the consolidated body having, along a body dimension, one of the following characteristics: decreasing strength, increasing strength, or decreasing ductility (strain hardening) and increasing ductility (strain hardening).

23 Claims, 5 Drawing Sheets

METAL CONSOLIDATION PROCESS APPLICABLE TO FUNCTIONALLY GRADIENT MATERIAL (FGM) COMPOSITIONS OF TANTALUM AND OTHER MATERIALS

This application is a continuation-in-part of prior U.S. patent application Ser. No. 09/551,248, filed Apr. 18, 2000, now U.S. Pat. No. 6,355,209 incorporated herein by reference, which claims priority to Provisional Application Serial No. 60/165,781 filed Nov. 16, 1999.

BACKGROUND OF THE INVENTION

This invention relates generally to the field of consolidating hard metallic bodies, and also to rapid and efficient and heating and handling of granular media employed in such consolidation, as well as rapid and efficient heating and handling of preform powdered metal or metal bodies to be consolidated, where such bodies consist essentially of functionally gradient materials, designated herein as FGM. Such materials when consolidated exhibit along a body dimension or dimensions decreased or varying strength or ductility (strain hardening).

The technique of employing carbonaceous particulate or grain at high temperature as pressure transmitting media for producing high density metallic objects is discussed at length in U.S. Pat. Nos. 4,140,711, 4,933,140 and 4,539,175, the disclosures of which are incorporated herein, by reference.

The present invention provides improvements in such techniques, and particularly improvement leading to consolidation of bodies consisting essentially of functionally gradient material (FGM) compositions. One example is tantalum or tantalum together with other metals. Such metals, one or more of which may be consolidated with tantalum, include tungsten, copper, hafnium, rhenium, platinum, gold, molybdenum, uranium, titanium, zirconium and aluminum.

SUMMARY OF THE INVENTION

It is a major object of the invention to provide for consolidation of metallic powder consisting of selected metals as referred to, and as may be employed in target penetration, drilling, and related impact activities. Such selected metals typically are distributed as FGMs, as referred to.

It is another object of the invention to provide rapid and efficient heating of carbonaceous and/or ceramic particles used as pressure transmitting media, and also transfer of heat generated in the particles to the work, i.e. the hard metal preform to be consolidated. Basic steps of the method of consolidating the preform metallic body in any of initially powdered, sintered, fibrous, sponge, or other form capable of compaction, or densification (to reduce porosity) then include the steps:

a) providing flowable particles having carbonaceous and ceramic composition or compositions, b) heating the particles to elevated temperature, c) locating the heated particles in a bed, d) positioning the preform body at the bed, to receive pressure transmission, e) effecting pressurization of said bed to cause pressure transmission via said particles to the body, thereby to compact the body into desired shape, as for example cylindrical shape, increasing its density, and f) the body consisting essentially of one or more metals selected from the following group: tungsten, rhenium, uranium, tantalum, platinum, copper, gold, hafnium, molybdenum, titanium, zirconium and aluminum, g) the consolidated body having, along a body dimension, one of the following characteristics:

i) decreasing strength ii) increasing ductility iii) decreasing strength, and increasing ductility.

Another object is to achieve rapid or almost instantaneous densification of a composite metal alloy system, the resultant material being fine grained, isotropic, and maintaining original metastable microstructures.

A further object is to produce a consolidated functionally gradient material (FGM) for use as a shaped, heavy metal penetrator EFP (explosively formed penetrator) or SCL (shaped charge lines). One highly advantageous and particular FGM material powder system is comprised of a tantalum and other heavy metal powdered alloy outer section, and transitioning to a different density based powder. It may include an intermediate layer of metal matrix composite of the heavy metal alloy, and lower density powder, and a monolithic lower density base section. The powdered material system for process A may typically employ tantalum particles coated with a pre-alloyed binder composition but other elementally blended, mixed or otherwise combined particles are applicable. The total binder may typically consist of elemental metals selected from the group tungsten, copper, tantalum, hafnium, rhenium, platinum, gold, molybdenum, and uranium hereinafter referred to as HMG, of approximately 16 weight percent of the total composition; but other compositions may be employed. The powdered material system for a process B may typically employ transition layers of one metal to the next with the build-up based on requirements.

The ability to fabricate a functionally gradient heavy metal penetrator in one single forging operation has several advantages. The first is the ability to design and engineer a penetrator with specific and predictable dynamic performance criteria. The second advantage is that of reduced manufacturing costs directly related to fewer hot forging steps. Additional cost reductions are realized in the area of raw material usage by eliminating forging trim and scrappage resulting from the use of a powder metallurgy, near net shape forging preform.

By the use of the methodology of the present invention, substantially improved structural articles of manufacture can be made having minimal distortion, as particularly enabled by the use of carbonaceous, or ceramic, or carbonaceous/ceramic particulate in flowable form.

An additional object includes provision of a method for consolidating hard metal and/or ceramic powder, and/or composite material with or without polymeric powder, to form an object, that includes a) pressing the FGM into a preform, and preheating the preform to elevated temperature, b) providing flowable pressure transmitting particles and heating said particles, and providing a bed of said flowable and heated pressure transmitting particles, c) positioning the FGM preform in such relation to the bed that the particles substantially encompass the preform, d) and pressurizing the bed to compress said particles and cause pressure transmission via the particles to the preform, thereby to consolidate the preform into a desired object shape, having final density.

The preform typically consists of tantalum complex with metals selected from the HGM group as referred to.

An additional object is to provide a body to be consolidated having varying metallic composition along a body dimension. That varying composition may be characterized by a series of zones, extending either axially or radially for example along the article's axis, each zone having a characteristic composition which differs from that of an adjacent zone or zones. The metal in successive zones may consist of at least consolidated tantalum, and tantalum consolidated together with one or more metals from the HGM group, and also steel, but in varying proportions in successive zones. For a projectile having great penetration capability, a tapered nose zone may consist primarily of tantalum, and successive zones to the rear may contain less and less tantalum and more and more steel.

For a three metal body, the metals being $M_1$, $M_2$ and $M_3$, the weights $W_1$, $W_2$ and $W_3$ per unit volume of the respective metals $M_1$, $M_2$ and $M_3$ are related and selected, to be as follows:

$$W_1>W_2>W_3$$

Other objects are to provide consolidated bodies such as tapered shells, and/or cylindrical and tapered bodies, made by the method of the invention, and having functional gradient properties in two dimensions.

The novel features which are believed to be characteristic of this invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purposes of illustration and description only and are not intended as a definition of the limits of the invention.

DRAWING DESCRIPTION

Figure 8A:
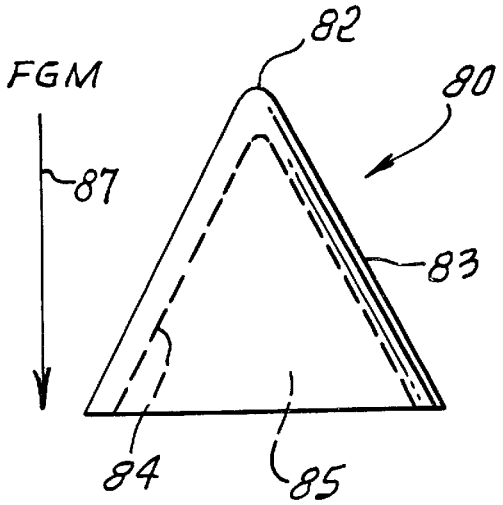
Figure 8B:
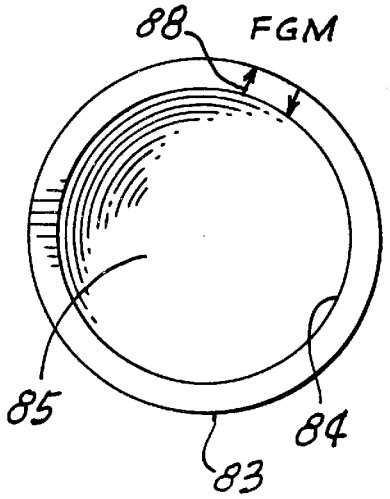
Figure 9A:
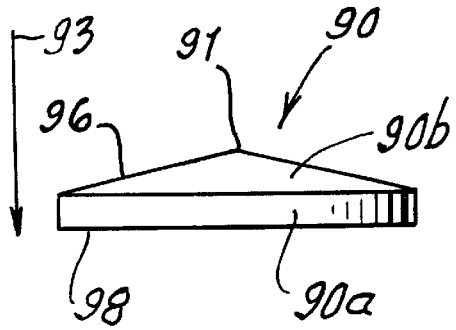
Figure 9B:
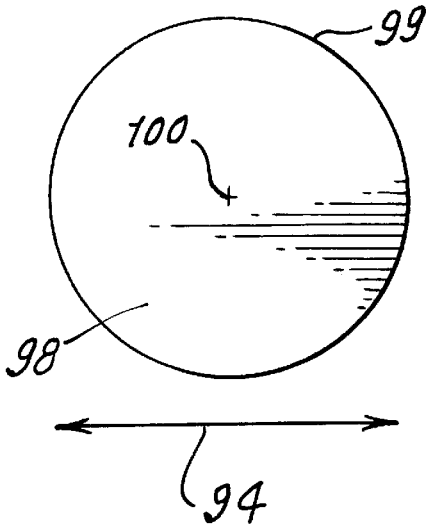

FIGS. 8*a* and 8*b* are side and bottom views of a consolidated shaped charge liner (SCL) formed by the method of the invention; and FIGS. 9*a* and 9*b* are side and bottom views of a consolidated explosively formed penetration (EFP) formed by the method of the invention.

Figure 10A:
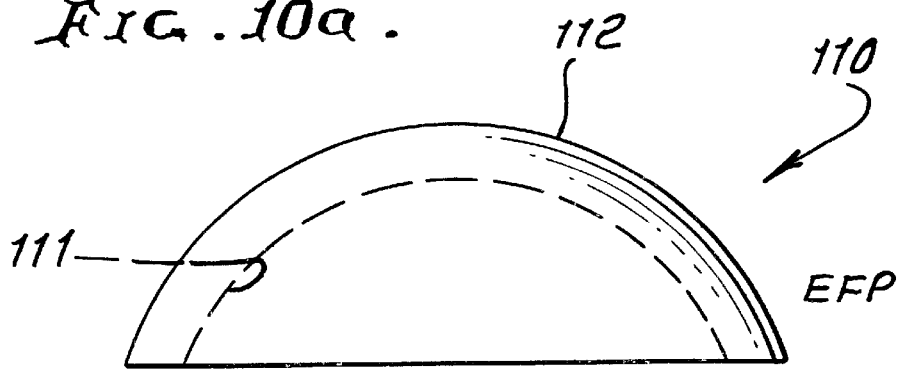
Figure 10B:
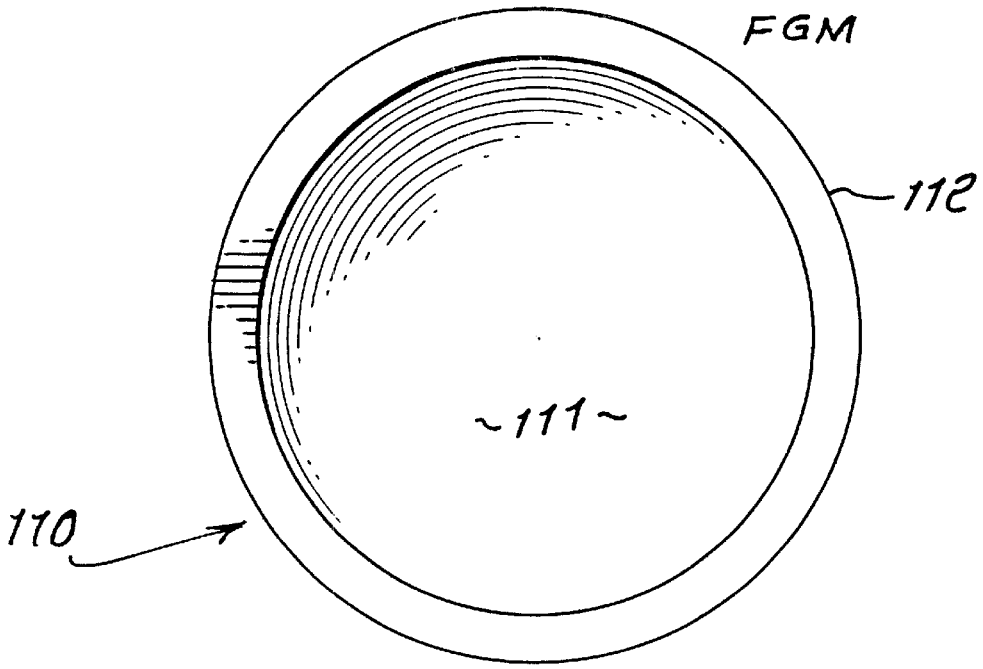

FIGS. 10*a* and 10*b* are side and bottom views of an EFP body.

DETAILED DESCRIPTION

Figure 1:
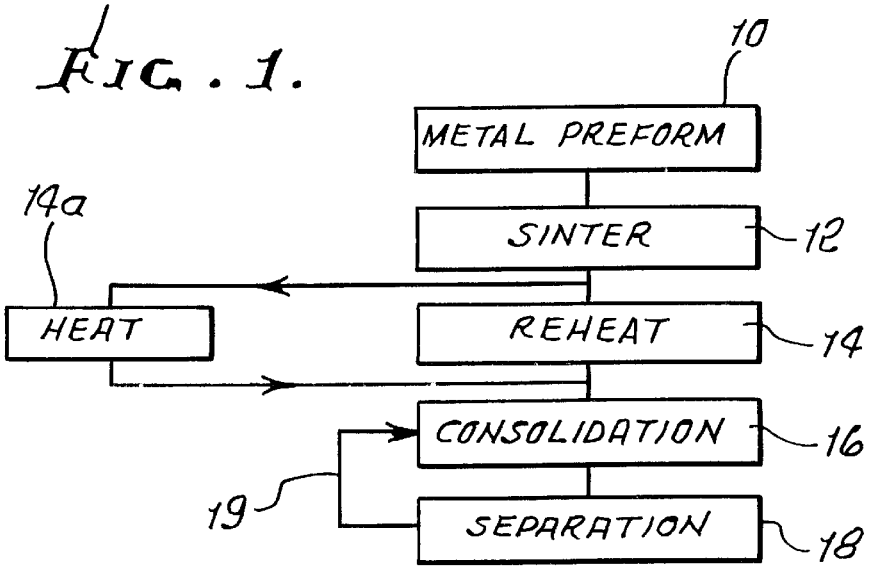
FIG. 1 is a flow diagram showing method steps of the present invention.
Figure 3:
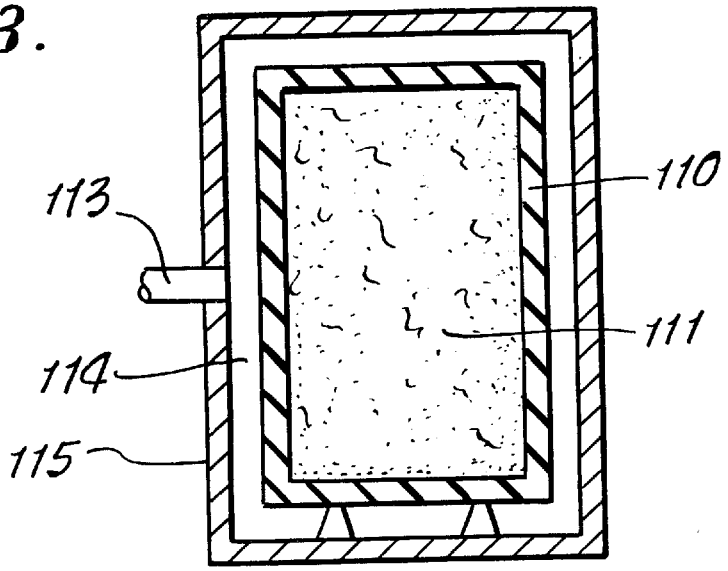
FIG. 3 is a vertical section showing preform pressurization, prior to consolidation.
Figure 6:
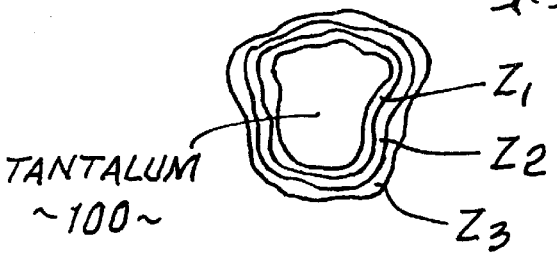
FIG. 6 shows a tantalum particle with layers of $Z_1$, $Z_2$, and $Z_3$ as found in a matrix.

Referring first to FIG. 1, there is shown a flow diagram illustrating method steps of the present invention. As can be seen from numeral 10, initially a metal, metal and ceramic, or ceramic article of manufacture or preform is made, for example, in the shape of a penetrator or other body or impact tool such as a drill or other product. One preferred embodiment contemplates the use of a metal preform made of powdered tantalum, partially coated with one or more HGM particles, then mechanically blended with a low alloy steel powder. Preferably, tantalum constitutes more than 50% of the overall weight of the preform. Other metallic or ceramic particles or coatings may also be included. See for example FIG. 6 showing tantalum particles 100 coated with or surrounded by metals $Z_1$, $Z_2$, and $Z_3$, in a preform. A preform typically is about 60 to 85 percent of theoretical density after the powder has been made and compacted into a preformed shape, and it may typically subsequently be sintered (see step 12 in FIG. 1) in order to increase the strength. In the preferred embodiment, the preform in billet form is subjected to cold or ambient temperature isostatic compaction at about 60,000 pounds per square inch, preferably within an evacuated and sealed elastomeric (rubber) container. See for example FIG. 3 showing evacuated, sealed elastomeric container 110, with the preform 111 located therein, and shaped in the form of a cylinder. Fluid pressure is supplied at 113 to the interior 114 of a metal vessel 115 within which the tantalum, and other powdered metal ($M_1$, $M_2$, etc.) preform, and its elastomeric container are located, to pressurize the container and compact the powder preform. Once the billet preform has been compacted to about 60% of theoretical density, it is heated in a protective or reducing atmosphere, such as Argon or hydrogen, to above 900° C., in preparation for consolidation. See step 14 in FIG. 1. Alternative steps include step 12 sintering in FIG. 1, and reheating at 14.

The consolidation process, illustrated at 16 in FIG. 1, takes place after the hot preform (removed from 110 and 115) has been placed, as for example in a bed of heated carbonaceous or carbonaceous/ceramic particles as hereinbelow discussed in greater detail. Consolidation takes place by subjecting the embedded preform to elevated temperature and high pressure. In a preferred embodiment, temperatures in the range of about 1,600° F. and uniaxial pressures of about 5 to 100 and higher TSI are used, for compaction. The preform has now been densified and can be separated, as noted at 18 in FIG. 1, whereby the carbonaceous particles separate readily from the preform and can be recycled as indicated at 19. If necessary, any particles adhering to the preform can be removed and the final product can be further finished, as for example machined.

Final product dimensional stability, to a high and desirable degree, is obtained when the particle (grain) bed primarily (and preferably substantially completely) consists of flowable carbonaceous and/or ceramic particles. For best results, such carbonaceous particles are resiliently compressible graphite beads, and they have outward projecting nodules on and spaced part on their generally spheroidally shaped outer surfaces, as well as surface fissures. See for example U.S. Pat. No. 4,640,711. Their preferred size is between 50 and 240 mesh. Useful granules are further identified as desulphurized petroleum coke. Such carbon or graphite particles have the following additional advantages in the process:

1. They form easily around corners and edges, to distribute applied pressure essentially uniformly to and over the body being compacted. The particles suffer very minimal fracture, under compaction pressure.
2. The particles are not abrasive, therefore reduced scoring and wear of the die is achieved.
3. They are elastically deformable, i.e. resiliently compressible under pressure and at elevated temperature, the particles being stable and usable up to 4,000° F.; it is found that the granules, accordingly, tend to separate easily from (i.e. do not adhere to) the body surface when the body is removed from the bed following compaction.

4. The granules do not agglomerate, i.e. cling to one another, as a result of the body compaction process. Accordingly, the particles are readily recycled, for reuse, as at 19 in FIG. 1.
5. The graphite particles become rapidly heated in response to passage of electrical current or microwaves therethrough. The particles are stable and usable at elevated temperatures up to 4,000° F. Even though graphite oxidizes in air at temperatures over 800° F. Short exposures as during heatup and cooldown, do not substantially harm the graphite particles.

Figure 2:
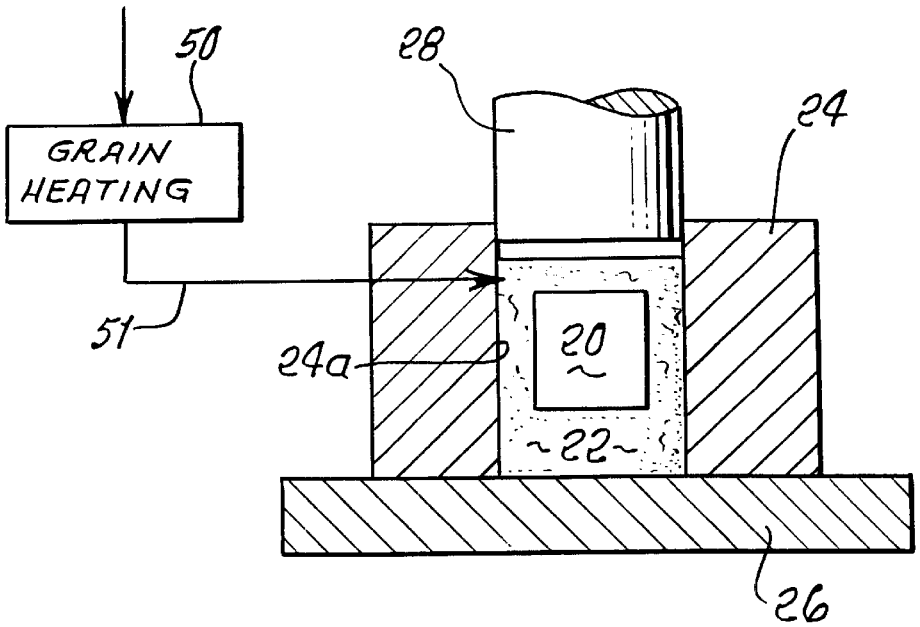
FIG. 2 is a cut-away elevation showing the consolidation step of the present invention.

Referring now to FIG. 2, the consolidation step is more completely illustrated. In the preferred embodiment, the preform 20 (as for example preform 111 in FIG. 3 or preform 111*a* in FIG. 4) has been completely embedded in a bed of carbonaceous particles 22 as described, and which in turn have been placed in a contained zone 24*a* as in consolidation die 24. Press bed 26 forms a bottom platen, while hydraulic press ram 28 defines a top and is used to press down onto the particles 22 which distributes the applied pressure non-isostatically (30% deformation (compression) axially-10% deformation (tensile) radially) to the preform 20. The preform is at a temperature between 200° C. and 1,800° C., prior to compaction. The embedded metal powder preform 20 is rapidly compressed under high uniaxial pressure by the action of ram 28 in die 24, the grain having been heated to between 400° C. and 4,000° F. Pressurization is typically effected at levels greater than about 20,000 psi for a time interval of less than about 30 seconds. Particles may be located within a sub-bed in a deformable container, in bed 22.

Referring again to FIG. 2, a heating furnace 50 is shown, incorporating a fluidized bed of grain particles, to be supplied at 51 to die 24. Such PTM can be a carbonaceous and ceramic composite of varying composition ranging from 5 to 95 percent, by volume, of ceramic particles, the balance being carbonaceous particles. Usable ceramics include: aluminum oxide, boron carbide or nitride, and other hard ceramic materials. The heater may comprise an electrical resistance heater, or a microwave heater, for example.

Figure 4:
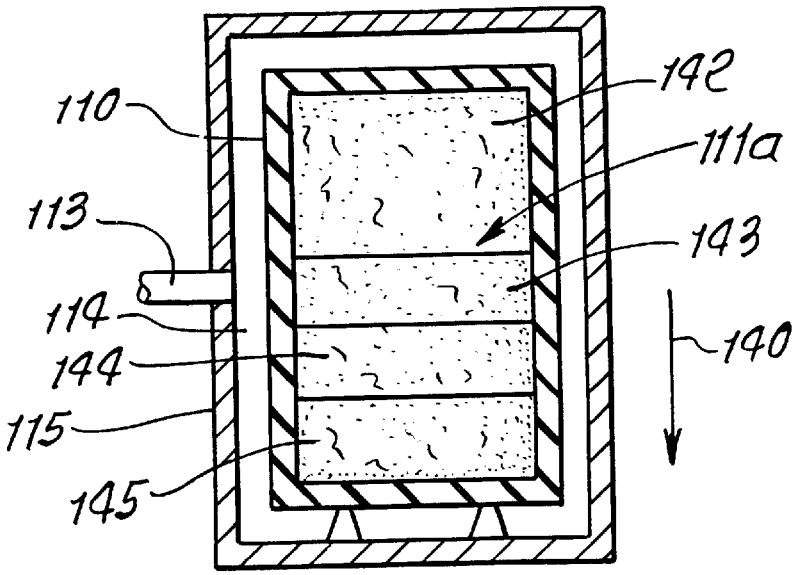
FIG. 4 is a view like FIG. 3, showing a modified preform.

FIG. 4 shows a preform 111*a*, similar to that at 111 in FIG. 3; however, the metal composition of the preform varies along its length direction, indicated by arrow 140. A stratified overall composition is indicated by multiple layers as for example at 142–145. Each layer may consist of one or more of powder form metals $M_1$ and $M_2$ (or mixture thereof), or metals $M_1$, $M_2$ and $M_3$ (or mixtures thereof), or metals $M_1$, $M_2$, $M_3$, $M_4$, $M_5$, and $M_6$ (or mixtures thereof). The selection of metals and mixtures, and their proportions as by weight, may be such as to produce an ultimate consolidated article wherein the strength and ductility of the article (at zones corresponding to layers 142–145) varies, in the length direction 140; for example the hardness may decrease, progressively, in direction 140.

In FIG. 4, each layer may consist of one or more of powder form metals $M_1$ and $M_2$ (or mixture thereof), or metals $M_1$, $M_2$ and $M_3$ (or mixtures thereof) or metals $M_1$, $M_2$, $M_3$ and $M_4$ (or mixtures thereof), or metals $M_1$, $M_2$, $M_3$, $M_4$ and $M_5$ (or mixtures thereof), or $M_1$, $M_2$, $M_3$, $M_4$, $M_5$, and $M_6$ (or mixtures thereof). Again, the selection of metals may be such that ultimate strength decreases and ductility increases, progressively and stepwise, in direction 140. Thus, for example, the layer 142 consists of the very strong high density metal such as tantalum adapted for high velocity penetration of armor plate, or other hard target structures such as reinforced concrete and steel, underground bunkers such as those used to protect chemical and biological weapons of mass destruction (WMD). The opposite end layer 145 may consist primarily of copper, etc. for high ductility and performance.

Layer 142 may consist of particles of tantalum encapsulated within layers of one or more HGM metal particles, and defined as powder A. Layer 145 may consist of particles of low alloy steel, defined as powder B. Intermediate layers 143 and 144 may consist of mixtures of powder A and powder B, where the percentage by weight of powder A decreases in successive layers in direction 140, and the percentage by weight of powder B in successive layers increases in direction 140.

One example of the transition layer composition in FIG. 4 would be as follows:

Layer 142 consists primarily of powder A

Layer 143 consists of 80% powder A and 20% powder B

Layer 144 consists of 60% powder A and 40% powder B

A further layer if used consists of 40% powder A and 60% powder B

A further layer if used consists of 20% powder A and 80% powder B

Layer 145 consists of 100% powder B

A further definition of the composite is as follows: the body may be of a SCL or EFP shape as discussed rates, the body consisting of at least two metals, $M_1$ and $M_2$, the proportions of $M_1$ and $M_2$ in said body nose portion and second body portion being different. For example, the metal $M_1$ is tantalum, the proportion of tantalum in that nose portion being greater than the proportion of tantalum in said second body portion. Further, the body has third and fourth body portions along said dimension, the proportion of tantalum in said second body portion exceeding the proportion of tantalum in said third body portion, and the proportion of tantalum in said third body portion exceeding the proportion of tantalum in said fourth body portion.

In addition, the body has first and second ends, the consolidated metal at the first end having higher density than the consolidated metal at the second end; and wherein the metal at the first end consists primarily of tantalum, and the metal at the second end consists primarily of a different density and performance characteristic material, i.e., pyrophoric.

Figure 5:
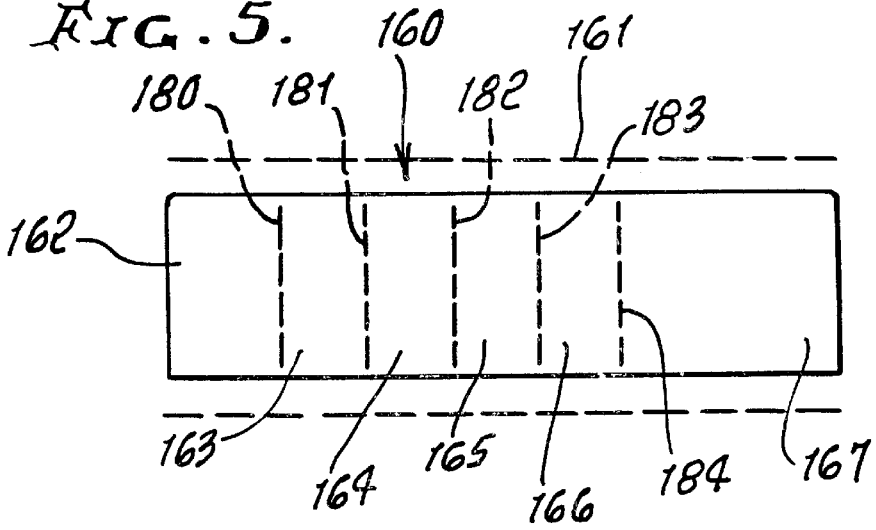
FIG. 5 is a view of a consolidated preform.

FIG. 5 shows by way of example a product 160 shaped generally like that of the preform 111*a*. The product 160 has been pressure consolidated, as described, to reduce its size from preform size indicated by the broken lines 161. Forward portion 162 consists essentially of tantalum; the next layer portion 163 in sequence consists of 20% by weight of a lower density metal (LDM) and the balance tantalum; the next layered portion 164 in sequence consists of 40% lower density metal (LDM) and the balance tantalum; the next layered portion 165 in sequence consists of 60% lower density metal and the balance tantalum; the next layered portion 166 in sequence consists of 80% lower density metal (LDM) and the balance tantalum; and the last layer 167 consists essentially of LDM. The layer thicknesses can be adjusted to lower increments to improve the FGM bond.

The process of the invention yields a fully dense microstructure and metallurgically sound bonds at 180–184, across the layered zones 162–167.

Figure 7:
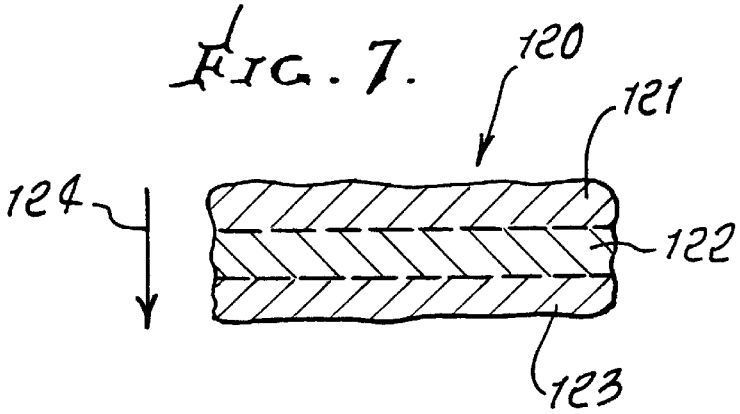
FIG. 7 is a section taken through multiple layers of different metals.

In FIG. 7 a "Process B" formed shape 120 consists of metallic layers 121–123 with decreasing strength in direction 124. The layers are consolidated as described above. Typical layers are:

121—tantalum

122—copper

123—aluminum

Density decreases in direction 124.

In FIGS. 8*a* and 8*b,* a shaped charge liner 80 has conical shell form, with a base 81, convex nose 82, outer side wall 83 tapering toward 82, and inner side wall 84 tapering toward 82. Wall 84 surrounds or forms inner cavity 85. The liner is formed by the method of the invention, i.e. is a consolidated body, and has FGM property (decreasing strength and/or ductility) in axial length direction 87; and FGM property (decreasing hardness and/or toughness) in wall thickness direction 88, those directions indicated by arrows, as shown. Thus, the outer side is more ductile than the inner side, and the nose 82 is more ductile than the base 81.

In FIGS. 9*a* and 9*b,* a penetrator 90 has combined cylindrical and tapered shape (as at sections 90*a* and 90*b* as shown), and is a solid body. Section 90*b* tapers toward tip 91. The penetrator is formed by the method of the invention, i.e. is a consolidated body, and has FGM property (increasing strength and/or ductility in axial length direction 93; and FGM property (decreasing strength and/or ductility) in center-to-side directions 94. Those directions are indicated by arrows as shown. Thus, the tip 91 and tapered wall 96 are stronger than the base 98; and body outer side 99 is stronger than body center 100.

In FIGS. 10*a* and 10*b,* an EFP body 110 is shown in side and bottom views. A body hollow 111 is formed below a domed top 112.

In each of FIGS. 8*a,* 8*b,* 9*a,* 9*b,* 10*a,* and 10*b,* the body at its toughest zone may consist of tantalum, and at less tough zone may consist of tantalum complexed with metal or metals selected from the above HGM group.

The basic preferred method of consolidating a body in any of initially powdered, sintered, fibrous, sponge, or other form capable of compaction, that includes the steps:

a) providing flowable pressure transmission particles having carbonaceous and ceramic composition or compositions, b) heating said particles to elevated temperature, c) locating said heated particles in a bed, d) positioning said body at said bed, to receive pressure transmission, e) effecting pressurization of said bed to cause pressure transmission via said particles to said body, thereby to compact and consolidate the body into desired shape, increasing its density;

f) the body consisting essentially of one or more metals selected from the following group: tungsten, rhenium, uranium, tantalum, platinum, copper, gold, hafnium, molybdenum, titanium, zirconium and aluminum;

g) said consolidated body having, along a body dimension, one of the following characteristics:
   i) decreasing strength
   ii) increasing ductility
   iii) decreasing strength, and increasing ductility.

Typically, the body has varying metallic composition along said dimension; and the varying metallic composition is characterized by a series of zones, the metal of each zone having a characteristic composition which differs from that of an adjacent zone or zones. Further, the metals in at least two successive zones consist substantially of tantalum, and tantalum consolidated with a metal or metals selected from the group tungsten, rhenium, uranium, tantalum, platinum, copper, gold, hafnium, molybdenum, titanium, zirconium and aluminum.

The body may consist of powders of metals that have been initially combined and compressed into body form, at pressure exceeding 20,000 pounds per square inch, prior to said step e) pressurization. At least part of the body has one of the following forms:

i) cone ii) lens iii) cylinder iv) cylinder and cone combination v) cylinder and lens combination.

The disclosure of U.S. patent application Ser. No. 09/239,268 is also incorporated herein, by reference. Accordingly, the consolidated tantalum may have <111>texture less than about 2.8X random.

We claim:

1. In the method of consolidating a body in any of initially powdered, sintered, fibrous, sponge, or other form capable of compaction, that includes the steps:

a) providing flowable pressure transmission particles having carbonaceous and ceramic composition or compositions, b) heating said particles to elevated temperature, c) locating said heated particles in a bed, d) positioning said body at said bed, to receive pressure transmission, e) effecting pressurization of said bed to cause pressure transmission via said particles to said body, thereby to compact and consolidate the body into desired shape, increasing its density;

f) the body consisting essentially of one or more metals selected from the following group: tungsten, rhenium, uranium, tantalum, platinum, copper, gold, hafnium, molybdenum, titanium, zirconium and aluminum;

g) said consolidated body having, along a body dimension, one of the following characteristics:
   i) decreasing strength
   ii) increasing ductility
   iii) decreasing strength, and increasing ductility.

2. The method of claim 1 wherein the body has varying metallic composition along said dimension.

3. The method of claim 1 wherein said varying metallic composition is characterized by a series of zones, the metal of each zone having a characteristic composition which differs from that of an adjacent zone or zones.

4. The method of claim 3 wherein the metals in at least two successive zones consist substantially of tantalum, and tantalum consolidated with a metal or metals selected from the group tungsten, rhenium, uranium, tantalum, platinum, copper, gold, hafnium, molybdenum, titanium, zirconium and aluminum.

5. The method of claim 1 wherein said body consists of powders of metals that have been initially combined and compressed into body form, at pressure exceeding 20,000 pounds per square inch, prior to said step e) pressurization.

6. The method of claim 5 wherein at least part of said body has one of the following forms:

i) cone ii) lens iii) cylinder iv) cylinder and cone combination v) cylinder and lens combination.

7. The method of claim 5 including preheating said body to temperature in excess of 900° C., subsequent to said initial combining and compressing and prior to said pressurization.

8. The method of claim 5 including effecting said initial combining and compressing at ambient temperature.

9. The method of claim 5 including providing an elastomeric container, positioning said powders in said container, and effecting said initial compressing by compressing said container.

10. The method of claim 9 including evacuating gases from said container, prior to said initial compressing thereof.

11. The method of claim 10 including sealing of said container after evacuating gases therefrom.

12. The method of claim 11 wherein said initial compressing is effected to compress the body to about 60% of body theoretical density.

13. The method of claim 1 wherein said pressurization is effected to form the body into generally conical shape.

14. The method of claim 1 including effecting said initial compressing to form the body into generally cylindrical shape, with taper at one end.

15. The method of claim 14 wherein said pressurization is carried out to reduce the body size while maintaining body generally cylindrical shape with taper at one end.

16. The method of claim 5 wherein the powders at one zone of the body consist essentially of tantalum particles coated with substance or substances selected from the group that include tungsten, rhenium, uranium, platinum, copper, gold, hafnium, molybdenum, titanium, zirconium and aluminum.

17. The method of claim 16 wherein the weight percent of said substance or substances is about 16% of the overall weight of the total powder.

18. The method of claim 1 wherein said particles are generally spheroidal and consist of graphite, and/or graphite and ceramic composite.

19. The method of claim 1 wherein said body in said bed, prior to said step e) is at a temperature between about 200° C. and 1,800° C.

20. The method of claim 1 wherein said body is positioned in said bed to be surrounded by said particulate, the bed consisting substantially entirely of particles in the form of graphite and/or graphite/ceramic beads.

21. The method of claim 15 wherein said bed contains sufficient of said flowable particles as to remain essentially free of agglomeration during said (e) step.

22. The method of claim 1 wherein said bed consists essentially of one of the following particulates:

i) graphite ii) ceramic iii) graphite and ceramic.

23. The method of claim 22 wherein the particle mesh size is between 50 and 240.

* * * * *